United States Patent [19]

Burster

[11] Patent Number: 5,052,266

[45] Date of Patent: Oct. 1, 1991

[54] PAGE TURNER FOR MUSIC MANUSCRIPTS AND THE LIKE

[76] Inventor: Robert C. Burster, 321 W. 30th St., Room D1, New York, N.Y. 10001

[21] Appl. No.: 503,322

[22] Filed: Apr. 2, 1990

[51] Int. Cl.[5] ..... G10G 7/00

[52] U.S. Cl. ..... 84/493; 84/505

[58] Field of Search ..... 84/486, 508-515, 84/489-499, 500-507

[56] References Cited

U.S. PATENT DOCUMENTS

| | | | |
|---|---|---|---|
| 1,327,621 | 1/1920 | Lindquist | 84/504 |
| 1,720,827 | 7/1929 | Ericsson | 84/511 |

*Primary Examiner*—Brian W. Brown

*Attorney, Agent, or Firm*—Schweitzer Cornman & Gross

[57] ABSTRACT

A mechanism is disclosed for automatically turning pages of a music manuscript or the like. The manuscript is supported on a music stand or the like, with the upper edges of its pages at or near the top of the support. Behind the support is a shaft mounting a plurality of pivotally movable, spring actuated control plates, each mounting a wire-like page turner element having an elongated laterally extending portion engagable with an outer upper corner area of a manuscript page. A sequential release mechanism, including a release pawl, operates in sequence to release the control plate for allowing the top most page of the manuscript to be turned, after first blocking the control plate for the next subsequent page to be turned. The release pawl mechanism permits any number of pages to be quickly back turned and brought into position for subsequent one-at-a-time release by the mechanism. To advantage, the mechanism may be actuated for one-at-a-time page turning operation by means of a cable release or the like actuated by the operator's foot.

10 Claims, 3 Drawing Sheets

PAGE TURNER FOR MUSIC MANUSCRIPTS AND THE LIKE

BACKGROUND AND SUMMARY OF THE INVENTION

The present invention is directed to a device for controllably turning the pages of a music manuscript, for example, as by means of a foot control or other device, so that a musician is able to advance the manuscript from page to page during play, without interruption. In the play or a multi-page musical score, for example, the musician is always faced with the problem of pre-freeing one hand from the instrument in order to excessively turn the pages of the manuscript. While a skilled musician is able to perform this task relatively quickly and unobtrusively, it requires in all cases that one hand be devoted, at least momentarily, to the task of turning the page. Where the player of the instrument requires both hands, the flow of play of the instrument is necessarily interrupted.

The present invention accordingly seeks to provide a simple yet highly reliable mechanism, operable by the musician and preferably without involving the musician's hands, to turn the pages of the manuscript, one at a time, upon the demand of the musician. The device of the invention may suitably be incorporated in a music stand, for example, or in any other environment where a music manuscript or the like is supported in a position to be read by the musician.

In accordance with one aspect of the invention, a page turning mechanism is provided, which incorporates a central vertical shaft, suitably mounted in relation to the music stand or other device on which the manuscript may be supported. The shaft mounts a series of rotatable, spring activated control plates, each carrying a page turning arm. At the outer end of each such arm is a clip engagable with a page of the manuscript. Associated with each of the control plates is a release mechanism, by which the spring activated control plates may be successively released, one at a time, for rotation through an arc of about 180°. As the spring activated control plates rotate, carrying with them the page turning arms, individual pages of the manuscript are turned in the manner desired.

According to one advantageous form of the invention, the release mechanism is actuated in a hand's-free manner, as by means of a foot-actuated cable release mechanism for example.

In accordance with another aspect of the invention, provision is made for manually turning pages backwards, automatically resetting the page turning mechanism for such pages, in order to accommodate musical scores in which repeat sections require back paging of the manuscript.

For a more complete understanding of the above and other features and advantages of the invention, reference should be made to the following detailed description of preferred embodiments of the invention, and to the accompanying drawings.

DESCRIPTION OF PREFERRED EMBODIMENTS

Figure 1:
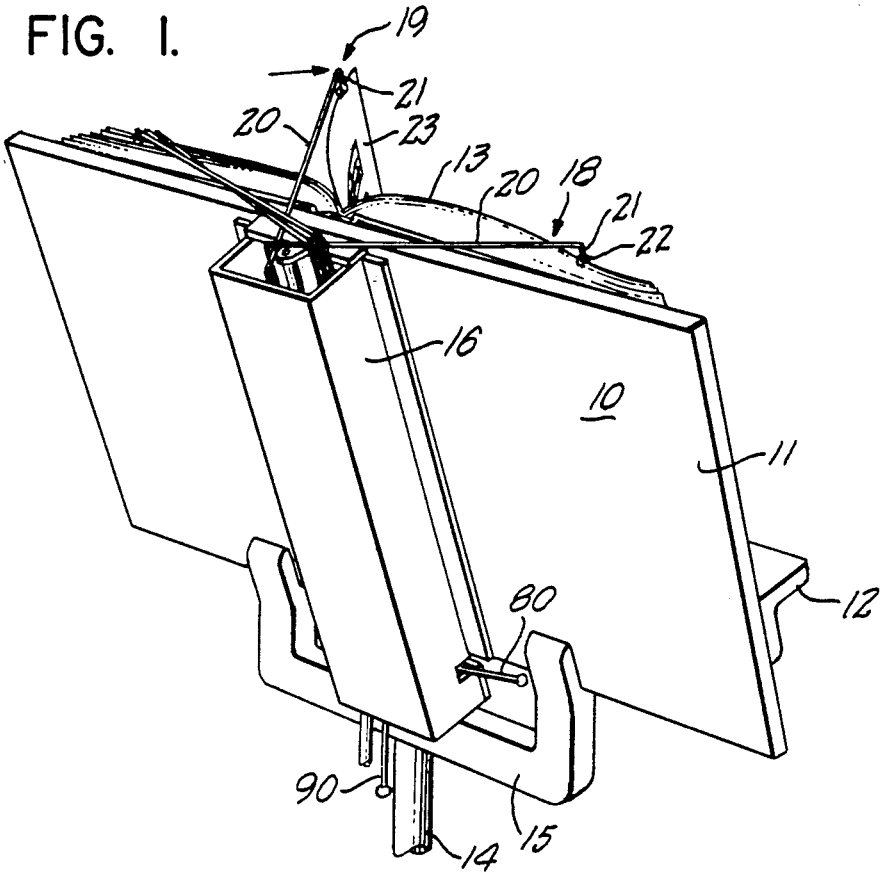
FIG. 1 is a fragmentary perspective illustration, from the back, of a music stand incorporating a page turning mechanism according to the invention.

Referring now to the drawing, and initially to FIG. 1 thereof, the reference numeral 10 designates generally a music stand apparatus for supporting a multi-page manuscript 13 or the like. The stand 10 includes a manuscript support 11 provided on its front side with a forwardly projecting support 12 for the bottom of the manuscript. In a typical case, the manuscript support 11 is mounted at an appropriate height by a vertical support member 14 which, in the illustrated example, is attached to the manuscript support 11 by means of a U-shaped bracket 15.

Mounted at the rear of the manuscript support 11 is a vertical housing 16 in which is mounted a vertical shaft 17. The shaft 17 carries, by means to be described, a plurality of page turning elements 18, advantageously in the form of lightweight, flexible wire-like elements 19, each including a generally horizontally directed section 20 extending over the top edge of the support 11, and over the tops of the pages of the manuscript 13. At their outer ends, the horizontal wire portions 20 are joined with short downwardly projecting portions 21 on which are mounted clips 22. Each clip is attached to a page 23 of the manuscript. In a typical apparatus, the wire elements 19 are provided in sufficient number to accommodate manuscripts of a predetermined size, such that for a manuscript of a typical length, a page turning element 18 is provided for each page.

Pursuant to the invention, each of the page turning wires 19 includes a vertically extending section 24 projecting downward from the inner end of the horizontal section 20 within the housing 16. At its lower end, each vertical section joins with a short horizontal section 25 mounted to a control plate 26. In the illustrated embodiment, each of the control plates 26 includes a wire supporting arm 27, extending from one side of the shaft 17, and a downwardly projecting control extension 28. As is evident in the drawings, each of the several control plates 26 is mounted on the shaft, so that successive control plates are positioned at successively higher elevations along the shaft. This enables the control plates to be released successively, one after the other, without concern for interference among the control plates or the respective page turning wires supported thereby.

Figure 4:
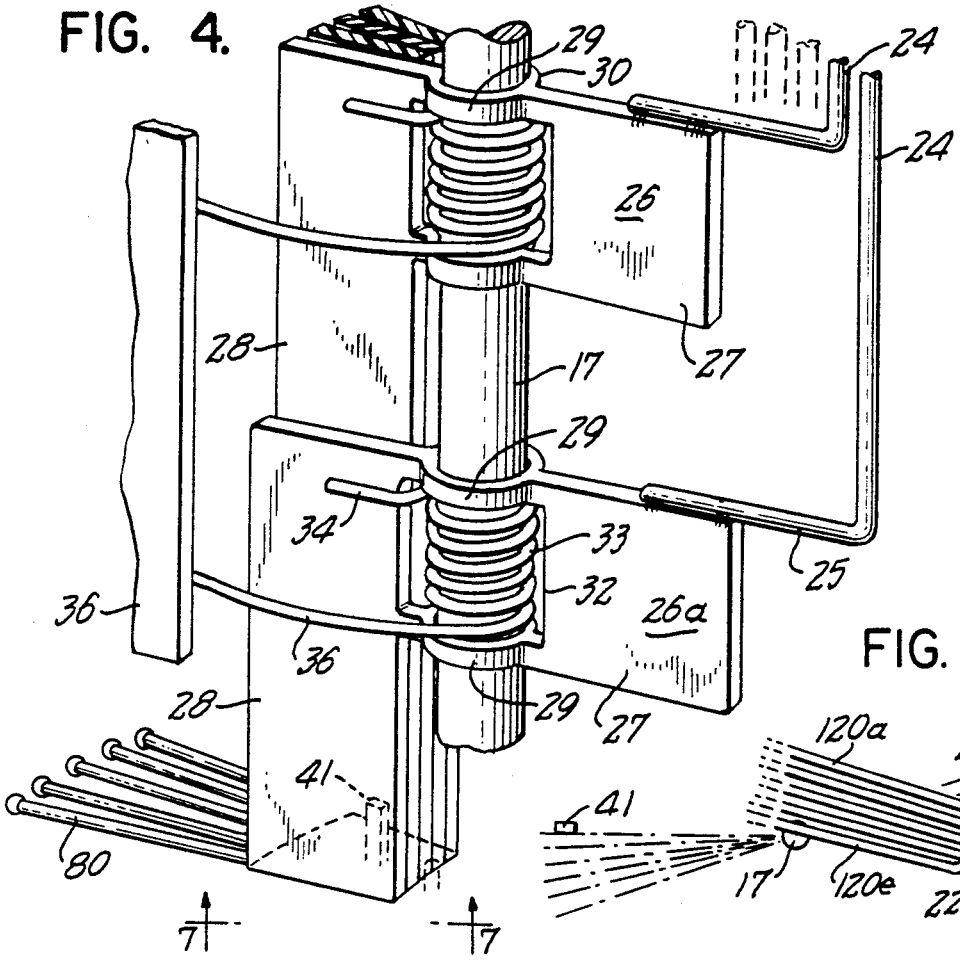
FIG. 4 is an enlarged, fragmentary perspective view illustrating the spring actuated control plate mechanism incorporated in the device of the invention.

In the illustrated arrangement, each control plate is spring-actuated to pivot in a clockwise direction, as looking down on the shaft 17 from the top. To advantage, the control plates may be formed of plastic, or stamped of sheet metal to provide shaft embracing portions 29, 30 near the upper and lower edges of the support arms 27, defining between them an opening 32. Within the openings are received coil springs 33. One end 34 of the coil spring rests against the vertical extension 28, while the other bears against an abutment surface 35 provided in the housing 16. The arrangement is such that the control plates are urged to rotate about the shaft from "cocked" positions, as shown in FIG. 4, to released positions approximately 180° therefrom.

Figure 2:
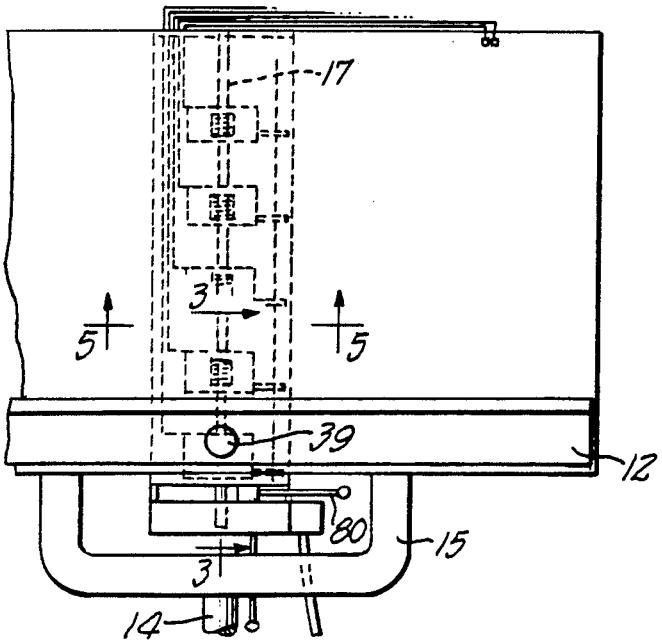
FIG. 2 is a fragmentary front view of the music stand of FIG. 1.
Figure 3:
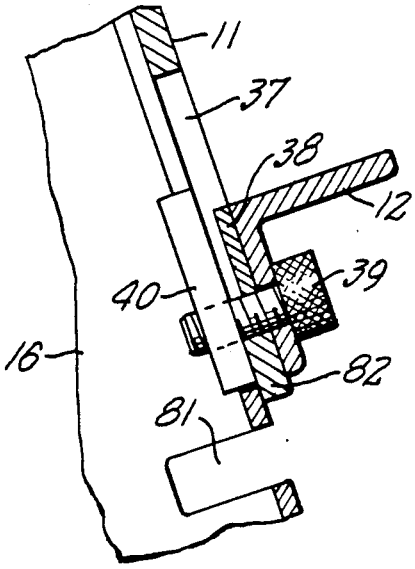
FIG. 3 is an enlarged fragmentary cross sectional view taken generally on line 3—3 of FIG. 2.

As reflected in FIGS. 1 and 2, the housing 16, shaft 17 and the related page turning mechanisms are mounted in fixed relation to the manuscript support 11. Accordingly, in order to accommodate manuscripts of more than one size, the bottom edge support 12, located at the front of the manuscript support, is vertically adjustable. To this end, the manuscript support 11 is provided with a central vertically elongated slot 37. A guide member 38, fixed to the bottom support 12, is slidable in the elongated slot 37 and serves to guide the support 12 in vertical movements therein, while retaining it in a horizontal orientation. A thumb screw or the like 39 extends through the slot 37 and engages a threaded plate 40, internally of the housing 16. By loosening the thumb screw 39, the bottom support 12 may be moved upward or downward on the face of the support 11. Suitably, appropriate calibrations are provided along the front surface of the support 11 to aid in locating the bottom surface 12 for properly positioning a given manuscript.

Figure 6:
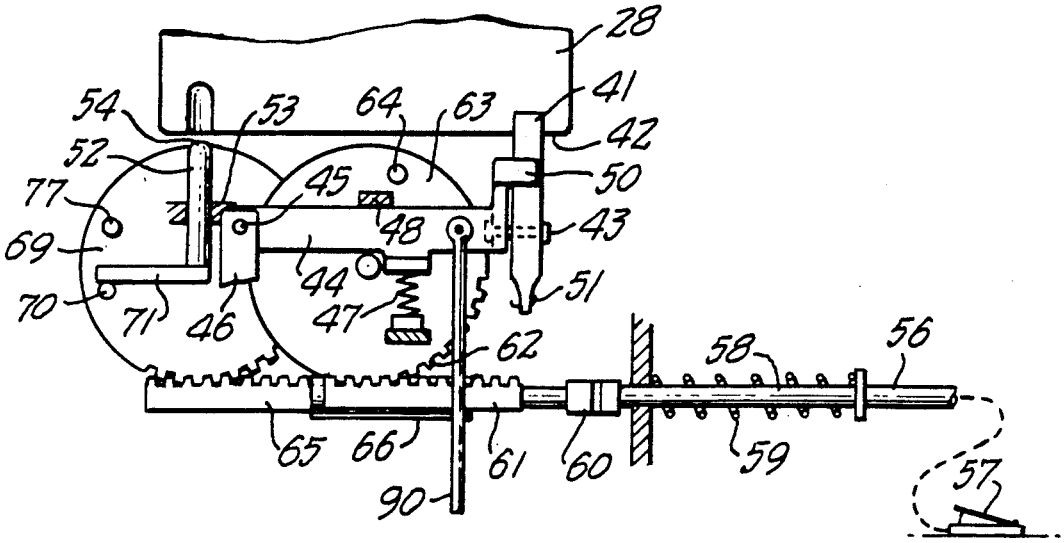
FIG. 6 is a fragmentary illustration showing a form of actuating mechanism useful in controlling the operation of the page turning elements.

In accordance with one aspect of the invention, a sequential release mechanism is provided for cooperation with the lower end portions of the control plate extensions 28. This release mechanism includes a release pawl 41, which extends vertically from below the control plate extensions 28 to a point slightly above the lower edge extremity 42 of the frontmost control plate. The release pawl 41, as shown in FIG. 6, is pivotally mounted by a pin 43 on a mounting arm 44. The mounting arm 44 is pivoted at 45 on a fixed bracket 46. The bracket 46 is normally urged upwardly by a spring 47, to a limit position determined by means such as an abutment stop 48. In the normal position of the arm 44, as shown in FIG. 6, the release pawl 41 projects slightly above the lower edge of the adjacent control plate extension 28.

In the illustrated form of the invention, the pawl mounting arm 44 includes a bracket 49, which may be integral with the arm 44, which mounts the pivot pin 43 for the release pawl 41. The bracket 49 includes an abutment tab 50 which limits pivoting movement in one direction of the release pawl 41. A spring 51, attached to the bottom of the release pawl, normally tends to pivot the pawl in a direction to swing it against the abutment stop 50. Thus, as shown in FIG. 6, for example, when the pawl mounting bracket 44 is in its raised or normal position, the spring-urged control plate extensions 28 press outwardly against the release pawl 41, pressing it firmly against the stop tab 50, so that the control extensions cannot be released unless the release pawl 41 is retracted downwardly by its mounting arm 44. On the other hand, adequate clearance is provided to allow the release pawl 41 to pivot freely in the opposite direction, against the action of the spring 51, allowing the control plate extensions 28 to be pivoted in the reverse directions, to their start positions, without requiring retraction of the arm 44.

Acting in conjunction with the release pawl 41 is a blocking pin 52, which is mounted in a guide block 53 for vertical movement from a "normal" position, in which the upper end 54 of the pin is below the lower edge 42 of the front control plate extensions 28 (see FIG. 6), to an actuated position (FIG. 10) in which the upper end of the pin is projected above the lower edges of the control plate extensions and into a region between the frontmost extension 28 and the extension directly behind it. To advantage, the control plate extensions 28 are provided, in the region directly above the blocking pin 52, with semi-cylindrical recesses 55 on opposite sides. Accordingly, opposed recesses of adjacent control plate extensions form a generally cylindrical recess for the free reception of the blocking pin 52 when the pin is elevated.

Figure 7:
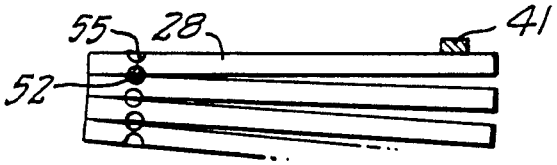
FIG. 7 is a fragmentary cross sectional illustration as taken generally on line 7—7 of FIG. 4.
Figure 8:
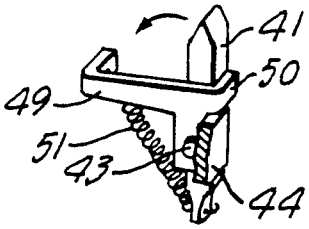
FIG. 8 is a fragmentary perspective view of a control element utilized in the controlled release of the several page turning elements.
Figure 10:
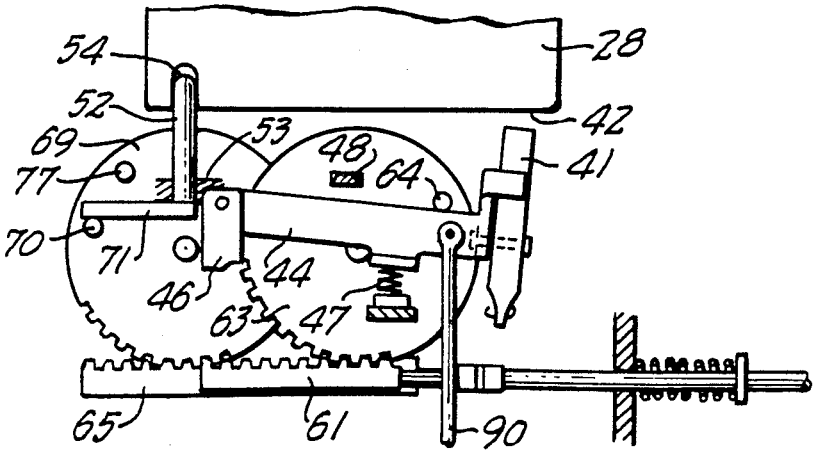
FIG. 10 is an illustration similar to FIG. 6, showing the mechanism in a state of partial actuation.

Pursuant to the invention, actuation of the device to effect the turning of a manuscript page is initiated by a sequence of operations which includes elevating the blocking pin 52 to an upraised position, as shown in FIG. 10, in which the pin is received within a recess formed between the front-most control plate extension 28, and the extension directly behind, as reflected in the view of FIG. 7, looking upward from the bottom. Immediately thereafter, the mounting lever 44 for the release pawl 41 is pivoted downward, carrying the release pawl 41 below the lower edge 42 of the frontmost control plate extension and thus allowing the associated control plate to be pivoted through approximately 180°, under the influence of its coil spring 33. The page turning wire 19 mounted on the released control plate likewise swings through a large angle, carried by its control plate, and carrying with it a page 23 of the manuscript, turning the page from one side to the other, in a manner reflected in FIG. 1.

After the control plate extension has been released, and the page turning operation initiated, as described, the release pawl 41 is returned to its normal position, by releasing the lever 44 and allowing the spring 47 to return it to its normal position, as shown in FIG. 6. After the pawl 41 has been returned to its normal, blocking position shown in FIG. 6, the blocking pin 52 is retracted, also to the position shown in FIG. 6. Retraction of the pin is desirable at this time in order to accommodate "resetting" of any or all of the page turning elements.

Within the principles of the invention, a variety of mechanisms may be employed for effecting the desired, sequential operation of the release pawl 41 and the blocking pin 52. In the illustrated and preferred arrangement, however, the actuation advantageously is effected by means of a cable release mechanism 56, which extends to a foot pedal or the like, symbolically indicated at 57 in FIG. 6, which can be actuated when desired by the operator. In the illustrated arrangement, the cable release mechanism includes an operating rod 58 urged by a spring 59 to a normal or retracted position, to the left as viewed in FIG. 6. The operating rod is connected by a bracket 60 to a rack 61 meshing with gear teeth 62 on a first rotatable actuating wheel 63. The wheel 63 carries a drive pin 64 arranged to engage the upper edge of the pawl mounting arm 44. Accordingly, as the rack 61 is driven inwardly (i.e. to the left in FIG. 6), the drive wheel 63 rotates in a clockwise direction until the pin 64 engages the lever, moving it downwardly, to the position shown in FIG. 10, in which the pawl releases the frontmost control plate.

Figure 9:
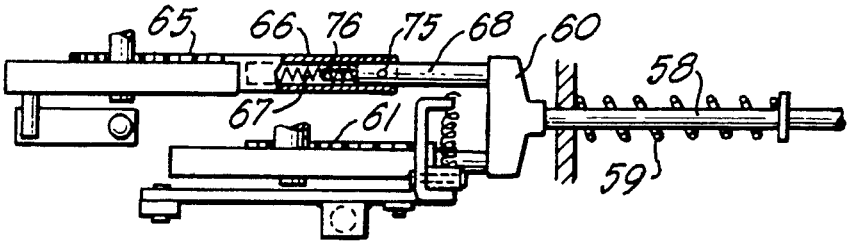
FIG. 9 is a fragmentary view looking down on the mechanism of FIG. 6.

A second rack 65 is also connected to the bracket 60, through a lost-motion connection including a tubular section 66, a compressible spring 67, and a telescoping rod 68. The spring 67 is initially preloaded to such an extent that actuating movement of the cable release rod 58, moving the bracket 60 and rod 68 to the left as shown in FIG. 9, the rack 65 moves along with the rod 68, rotating a second drive wheel 69 in a clockwise direction, as viewed in FIG. 6. By virtue of a drive pin 70, carried by the wheel 69, and an extending arm 71 carried by the blocking pin 52, the pin 52 is immediately, upon forward movement of the rack 65, elevated by upward movement of the drive pin 70 and the extension bar 71.

After a short initial rotation of the second drive wheel 69, the blocking pin 52 reaches its upward limit position, as shown in FIG. 10. At this point, the pin is stopped, as by means of abutment of the arm extensions 71 against the guide block 53.

At or shortly before the blocking pin 52 reaches its limit position, the drive pin 64, carried by the first drive wheel 63 engages the pawl mounting lever 44 and initiates its downward movement. Continued forward movement of the rack 61 and bracket 60 is accommodated during this period by compression of the spring 67 within the tube 68.

As soon as the pawl 41 is sufficiently retracted, the control plate is released and a page is turned. The next successive control plate is prevented from rotating, however, by the presence of the blocking pin 52.

As soon as the page turning has been initiated, the cable actuator is released, causing the rod 58 to be retracted toward its normal position. During the initial phase of such retracting movement, only the rack 61 moves to the right, while the rack 65 is retained in its position by continued compression in the spring. The lever 44 is urged back to its normal position by the spring 47 during this initial retracting motion.

As soon as the release pawl is in a blocking position, to prevent release of a control plate, the blocking pin 52 may be retracted. This is initiated by means of a pin 75, which is carried in the rod 68 and is slidable in a longitudinal slot 76 in the tubular element 66. When the pin 75 is bottomed against the outer end of its slot, the tubular member 66 is retracted along with the cable actuator rod 58 and bracket 60, rotating the drive wheel 69 in a counterclockwise direction. A drive pin 77 carried by the wheel 69 rotates to a predetermined point, where it engages the top of the extension bar 71 and drives the blocking pin 52 in a retracting direction.

Of course, any other suitable mechanism may be employed for sequentially actuating the release pawl 41 and blocking pin 42, it being understood that the proper sequence of operations should be followed, in which the blocking pin is extended to blocking position before the release pawl 41 is retracted, and that the release pawl be returned to a blocking position before the blocking pin 52 is retracted. This actuation may be accomplished by means of a manual push button, if desired, or by using solenoids or the like, or by other means. Preferably, however, a foot control is utilized, as this completely frees the hands of the operator. In the case of musical manuscripts in particular, this can be of importance.

For initially setting the various page turning elements in their "loaded" or "cocked" positions, ready for automatic page turning, the apparatus of the invention advantageously employs extension fingers 80, rigidly attached to the lower ends of the control plate extensions 28 and extending laterally through an opening 81 in the lower portion of the housing 16, accessible by the operator below the lower edge 82 of the manuscript support. In order to set the individual page turning elements in their loaded positions, the operator engages the elements 80 and swings them from left to right. The individual plate extensions 28 will pass over the release pawl 41, resiliently displacing the pawl rearwardly. This can be done at a one-at-a-time basis, or the operator can simply engage the rearwardmost of the extension fingers and pivot it around, carrying with it all of the other elements.

In the rendering of a musical score, for example, it is not uncommon for the music score to have one or more repeat sections, and this may require turning back one or more previously turned pages. With the apparatus of the present invention, this may be quickly accomplished by engaging a single finger extension and turning back and resetting all of the pages necessary to play the repeat section. To facilitate rapid recognition of the proper extension finger, color coding or other such identification means may be utilized.

It may be desirably, upon occasion, to release all of the loaded page turning elements simultaneously, as when concluding a session of use with the apparatus, with some pages of the manuscript still unturned or some of the page turning elements otherwise remaining in loaded positions. All of the remaining elements could, of course, be released by successive actuations of the foot control 57 or other actuating element. It is advantageous, however, to provide a simple release rod 90, which is pivotally connected to an outer end portion of the pawl mounting arm 44 and extends downwardly out of the bottom of the housing 16 (see FIG. 1) where it is easily accessible to the operator. By simply pulling downward on the rod 90, the release pawl 41 is retracted, without at the same time providing for positioning of the blocking pin 52. Accordingly, all of the still-loaded page turning elements are released simultaneously for return to their respective rest positions.

Figure 11:
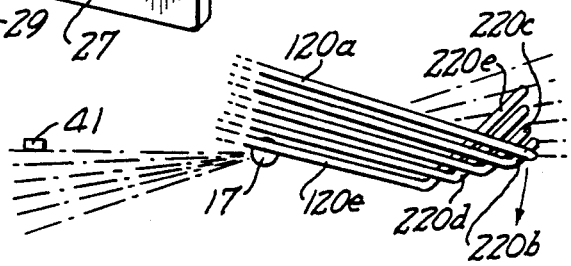
FIG. 11 is a fragmentary illustration of a modified form of the invention in which angularly configured page turning elements are employed.
Figure 5:
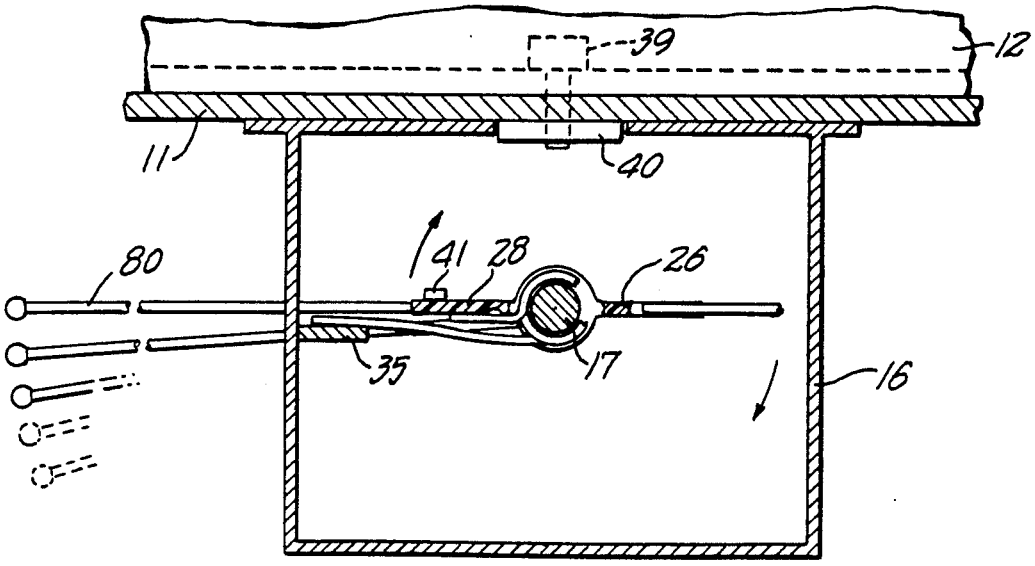
FIG. 5 is a fragmentary cross sectional view as taken generally on line 5—5 of FIG. 2.

To advantage, the wire-like page turning elements 18 are mounted on the side of the control elements 26 opposite the vertical edge of the page to which the element is attached. This provides for increased length of the horizontal portion 20 of the wire-like element, to provide a desirable degree of resilience and flexibility. Accordingly, during a page turning operation, one horizontal wire portion 20 will be crossing over or under another at a point well removed from its mounting area. Particularly, where a relatively large number of pages are being accommodated, there can be wire to wire contact resulting from eventual deformation of the wire-like elements through continued use, etc. To minimize the effects of such contact, a modified form of wire-like element, shown in FIG. 11, may be employed. In the modified version, the first wire-like element to be released can be of relatively straight configuration in its horizontal portion 120*a*. The next subsequent elements to be released each are formed with rearwardly projecting offsets 220*b*–220*e*, in the illustration of FIG. 11. The purpose of such offsets is to position each of the respective horizontal wire sections 120*a*–120*e* respectively behind all other wires which will be released earlier. The effect of such configuration is to cause the individual wires to cross each other in the immediate vicinity of the axis of the support 17, where a relatively higher degree of strength and stability is afforded. The function and operation of the modification of FIG. 11 is otherwise identical to that previously described.

It will be readily understood, of course, that the page turning mechanism of the invention may be incorporated in a variety of environments. For example, it may be employed in connection with a fold-up music stand. The device may be either stand-alone or formed as a part of a podium or stand as will be readily appreciated. Accordingly, reference should be made to the following appended claims in determining the full scope of the invention.

I claim:

1. An apparatus for turning pages of a manuscript wherein the manuscript has a back surface and top and bottom edges, which comprises:

(a) a manuscript support for supporting the back surface of the manuscript as well at its bottom edge, (b) a support shaft extending upward behind said manuscript support and having a rotation axis, (c) a plurality of control elements mounted on said support shaft for rotation about its axis, (d) spring means urging said control elements to rotate from a first operating position to a second operating position, (e) a plurality of page turning elements, one mounted on each control element for movement therewith, (f) said page turning elements including a first portion extending upward and a second portion extending laterally at or above the top edge of the manuscript pages, (g) page clips carried by said page turning elements and engageable with individual pages of the manuscript near outer edge portions of such pages, (h) release means associated with said control elements for effecting controlled release of said control elements in succession, (i) said release means comprising a release pawl, retractably positioned in front of and in position to block movement of a control element positioned to be next released, and a blocking element retractably movable to a positioned behind the last mentioned control element and in front of and in position to block movement of a control element to be next released in succession, and (j) remotely operated actuating means for effecting momentary retraction and return of said release pawl while said blocking element is in blocking position, and for retracting said blocking element after return of said release pawl.

2. An apparatus according to claim 1, further characterized by:

(a) said page turning elements comprising flexible, wire-like elements.

3. An apparatus according to claim 1, further characterized by:

(a) said control elements being mounted on said support shaft, one adjacent the other in axially spaced relation, (b) said page turning elements comprising lightweight, wire-like elements extending upward from their respective control elements to a level above the manuscript pages.

4. An apparatus according to claim 1, further characterized by:

(a) said manuscript support comprises a back support means and a bottom support element, and (b) means are provided for mounting said bottom support element for adjustable movement, vertically, with respect to said back support means, whereby manuscripts of differing vertical heights may be positioned with their top edges substantially at a uniform height with respect to said page turning elements.

5. An apparatus according to claim 3, further characterized by:

(a) said control elements having control plate means projecting downwardly alongside said shaft and terminating at a common level adjacent said release means.

6. An apparatus according to claim 5, further characterized by:

(a) at least certain of said control plate means having manually engageable reset fingers extending laterally therefrom and engageable manually by the operator for back turning of the page turning elements for resetting said elements in said first operating positions.

7. An apparatus according to claim 1, further characterized by:

(a) manually operated means for rotating said control elements against said spring means and into said first operating positions, (b) said release pawl being yieldably displaceable during reset movements of said control elements to said first operating positions, whereby said control elements may be reset without retracting said release pawl.

8. An apparatus according to claim 1, further characterized by:

(a) means for actuating said release pawl independently of said blocking element, whereby a plurality of said control elements may be simultaneously released from their said first operating positions.

9. An apparatus according to claim 2, further characterized by:

(a) said wire-like elements being mounted on said control elements on the side of said support shaft generally opposite the edges of the manuscript pages to which said wire-like elements are attached.

10. An apparatus according to claim 9, further characterized by:

(a) said wire-like elements being formed with generally rearwardly directed offsets located closely adjacent said support shaft and connected to horizontally extending portions of said elements extending to the manuscript pages to be turned thereby, whereby when said wire-like elements are in their respective first operating positions, the elements first to be released are disposed with their horizontally extending portions generally in front of the corresponding portions of wire-like elements subsequently to be released.

* * * * *